US006787999B2

(12) United States Patent
Stimac et al.

(10) Patent No.: US 6,787,999 B2
(45) Date of Patent: Sep. 7, 2004

(54) LED-BASED MODULAR LAMP

(75) Inventors: Tomislav J. Stimac, Concord, OH (US); James T. Petroski, Parma, OH (US); Robert J. Schindler, Euclid, OH (US); Greg E. Burkholder, Valley View, OH (US)

(73) Assignee: GELcore, LLC, Valley View, OH (US)

( * ) Notice: Subject to any disclaimer, the term of this patent is extended or adjusted under 35 U.S.C. 154(b) by 0 days.

(21) Appl. No.: 10/065,320

(22) Filed: Oct. 3, 2002

(65) Prior Publication Data

US 2004/0066142 A1 Apr. 8, 2004

(51) Int. Cl.[7] ..... H01J 13/49; F21S 4/00
(52) U.S. Cl. ..... 315/51; 362/800
(58) Field of Search ..... 362/236, 237, 362/239, 254, 264, 265, 294, 373, 800; 315/307, 308, 309, 51, 49, 318.01

(56) References Cited

U.S. PATENT DOCUMENTS

| | | | | |
|---|---|---|---|---|
| 6,016,038 | A | 1/2000 | Mueller et al. | 315/291 |
| 6,150,774 | A | 11/2000 | Mueller et al. | 315/291 |
| 6,166,496 | A | 12/2000 | Lys et al. | 315/316 |
| 6,211,626 | B1 | 4/2001 | Lys et al. | 315/291 |
| 6,254,262 | B1 | 7/2001 | Crunk et al. | 362/544 |
| 6,255,786 | B1 | 7/2001 | Yen | 315/291 |
| 6,292,901 | B1 | 9/2001 | Lys et al. | 713/300 |
| 6,371,636 | B1 | 4/2002 | Wesson | 362/545 |
| 6,414,801 | B1 * | 7/2002 | Roller | 359/726 |
| 6,501,084 | B1 * | 12/2002 | Sakai et al. | 250/504 R |
| 6,502,956 | B1 * | 1/2003 | Wu | 362/237 |
| 6,580,228 | B1 * | 6/2003 | Chen et al. | 315/185 R |
| 2003/0117797 | A1 * | 6/2003 | Sommers et al. | 362/237 |

FOREIGN PATENT DOCUMENTS

| | | |
|---|---|---|
| WO | WO 99/31560 | 6/1999 |
| WO | WO 01/82657 A1 | 11/2001 |
| WO | WO 02/061330 A2 | 8/2002 |

* cited by examiner

*Primary Examiner*—Wilson Lee
*Assistant Examiner*—Minh Dieu A
(74) *Attorney, Agent, or Firm*—Fay, Sharpe, Fagan, Minnich & McKee, LLP

(57) ABSTRACT

A lamp (10) includes an optics module (12) and an electronics module (14, 60, 70). The optics module (10) includes a plurality of LEDs (76) arranged on a printed circuit board (18) and having a plurality of input leads, and a heat sink (22) having a conduit (40) for the input leads. The plurality of LEDs (16) thermally communicate with the heat sink (22). The electronics module (14, 60, 70) is adapted to power the plurality of LEDs (16) through the input leads. The electronics module (14, 60, 70) has a first end (52) adapted to rigidly connect with the heat sink (22), and a selected electrical connector (50, 62, 72) arranged on a second end for receiving electrical power. The electronics module (14, 60, 70) further houses circuitry (80) arranged therewithin for adapting the received electrical power (82) to drive the LEDs (16).

22 Claims, 3 Drawing Sheets

LED-BASED MODULAR LAMP

BACKGROUND OF INVENTION

The invention relates to the lighting arts. It is especially applicable to MR/PAR-type lamps and lighting systems, and will be described with particular reference thereto. However, the invention will also find application in modular lighting, in portable lighting applications such as flashlights, in retrofitting incandescent and other types of lamps with LED-based lamps, in computerized stage or studio lighting applications, and the like.

MR/PAR-type lamps usually refer to incandescent lamps having an integrated directional reflector and optional integrated cover lens for producing a directed light beam with a selected beam spread, such as a spot beam or a flood beam. The integral reflector is typically of the mirrored reflector (MR) type which uses a dichroic glass reflector material, or of the parabolic aluminized reflector (PAR) type. The choice of reflector affects the heat distribution, spot size, lamp efficiency, and other properties. MR/PAR lamps are available in a wide range of reflector sizes, typically indicated in multiples of $1/8^{th}$ inch. For example, a lamp designated as PAR-16 has a parabolic reflector with a diameter of two inches. In the art, the terms MR lamp, PAR lamp, MR/PAR lamp, and the like typically denote a directional lamp having a standardized size, shape, and electrical connector. Commercial MR/PAR lamps are manufactured and sold as an integrated unit including an incandescent light source, a reflector that cooperates with the light source to produce a beam having a selected beam spread such as a spot beam or a flood beam, and a standardized base with an integrated standardized electrical connector which often also provides mechanical support for the lamp in the associated lighting fixture. Many commercial MR/PAR lamps additionally include a lens or cover glass arranged to receive light directed out of the reflector, a waterproof housing (optionally manufactured of a shatter-resistant material), or other features. Waterproof "sealed"MR/PAR lamps are especially suitable for outdoor applications or use in other harsh environments.

Commercial MR/PAR lamps exist which are compatible with a wide range of electrical input standards. Some are configured to accept an a.c. line power bus voltage, usually 110V in the United States or 220V in Europe. Low voltage lamps are configured to accept lower voltages, typically 12V d.c. although other voltages such as 6V or 24 V are also commercially used. The low voltage is typically supplied by the 110V or 220V power bus through a low-voltage transformer or other power conditioning apparatus external to the MR/PAR lamp.

Electrical power is typically supplied to the lamp via a standardized electrical base. There are many such "standardized" bases, however, including threaded (screw-type) connector bases, two-prong (bi-pin) connector bases, bayonet-style connector bases, and the like. Many of these standardized bases are available in a plurality of sizes or detailed configurations. For example, the GU-type connector known to the art comes in a variety of sized and configurations, usually denoted by GU-x where x is a sizing parameter.

In Europe, the most common electrical input standard employs a GU-10 connector configured to receive a 220V a.c. input. In the United States, the most common electrical input standard employs a screw-type connector known as an Edison connector configured to receive a 110V a.c. input. A commonplace low-voltage electrical input standard, sometimes called the "MR" standard, employs a GU-5.3 connector configured to receive 12V d.c. In addition to these standardized configurations, however, a wide range of other connector/power configurations are also in more limited use, particularly for specialized applications such as architectural and theatre lighting.

MR/PAR lamps are also increasingly being manufactured with integral electronic controllers, especially for high-end applications such as studio or stage lighting. In one known embodiment, a 12V d.c. MR lamp receives a DMX-512 control signal superimposed on the 12V power input. A DMX controller, embodied by a microprocessor arranged within and integral to the MR lamp, receives the control signal and optionally modifies the lamp operation in response to the received control instructions, for example by changing the lamp intensity or color. Incandescent MR/PAR lamps which include only a single light-generating filament are not individually color-controllable. Hence, the DMX color control is implemented through cooperation of several MR lamps of different colors, e.g. using red, green, and blue spot lights. Other controller interface protocols, such as PDA or CAN, are also known. Instead of using a superimposed a.c. control signal riding on the power input, in other embodiments a radio frequency (rf) receiver is incorporated into the MR/PAR lamp for receiving an rf control signal.

MR/PAR lamps employ a variety of light-generating mechanisms. In addition to incandescent filament lamps, tungsten halogen MR/PAR lamps are popular. In these lamps, a chemical reaction between a halogen gas ambient and a tungsten filament continually returns tungsten sputtered from the filament back onto the filament. In this way, degradation of the light intensity and color characteristics over time are reduced versus ordinary incandescent lamps. MR/PAR lamps employing other types of light generating elements, such as gas discharge tubes, are also known but have gained less commercial acceptance.

In particular, light emitting diode (LED)-based MR/PAR-type lamps are known. LEDs are solid state optoelectronic devices that produce light in response to electrical inputs. LEDs, particularly gallium nitride (GaN) and indium gallium aluminum phosphide (InGaAIP) based LEDs, are being increasingly used for lighting applications because of their durability, safe low-voltage operation, and long operating life. Present LEDs are produces relatively low optical output power, and so LED-based MR/PAR lamps usually include an array of LEDs that collectively act as a single light source. Because most LEDs produce a substantially directed light output, LED-based MR/PAR lamps optionally do not employ a reflector, or employ a reflector that is significantly different from reflectors used in incandescent or halogen MR/PAR lamps.

At the present time, LED-based MR/PAR lamps are not commercially dominant. In part, this is due to significant differences in the electrical input used by the LED arrays as compared with the input associated with conventional incandescent MR/PAR lamps, which can result in a significant portion of the development and manufacturing cost of LED retrofits going toward the power conditioning electronics and the related electrical connectors. To compete commercially, LED-based MR/PAR lamps are advantageously electrically and connectively interchangeable with existing lamp fixtures that are designed to operate with incandescent or halogen MR/PAR lamps.

The difficulty in achieving electrical and connective interchangeability is increased by the wide range of electrical power input standards used in the MR/PAR lamp industry, including voltage inputs ranging from around 6 volts to upwards of 220 volts, voltage inputs of either a.c. or d.c. type, and a wide range of different "standardized" power connection bases. The trend toward including remote control interfaces employing different communication pathways (rf versus superimposed a.c. line, for example) and different communication protocols (e.g., DMX, PDA, or CAN) further segments the market for LED-based MR/PAR lamps. The diversity of power and communications standards in the MR/PAR lamp industry influences the LED-based MR/PAR lamp manufacturer to produce and maintain a very broad lamp inventory including a large number of different lamp models, an undertaking which is difficult to justify given the present market share of LED-based MR/PAR lamps and the segmented nature of the MR/PAR lamp market in general.

The present invention contemplates an improved apparatus and method that overcomes the above-mentioned limitations and others.

SUMMARY OF INVENTION

In accordance with one embodiment of the present invention, a lamp is disclosed, including an optical module and an electronics module. The optical module includes a plurality of LEDs for emitting light, and a heat sink thermally coupled to the LEDs. The heat sink has an electrical conduit for transmitting conditioned electrical power to the LEDs. The electronics module includes an input electrical interface adapted to receive input electrical power, and an output coupler rigidly attaching to the optical module for delivering conditioned electrical power to the electrical conduit. The electronics module further includes electrical conditioning circuitry for electrically coupling the input electrical interface to the output coupler.

In accordance with another embodiment of the present invention, an apparatus is disclosed for connecting an associated lamp to an associated electrical power supply. The associated lamp has one or more light emitting diodes (LEDs) and a first coupling element adapted to convey conditioned electrical power to the LEDs. The apparatus includes an input electrical interface adapted to operatively connect to the associated electrical power supply to receive input electrical power and a second coupling element adapted to cooperate with the first coupling element to selectively detachably connect the optical module and the apparatus together. The second coupling element is adapted to electrically connect with the first coupling element to transmit conditioned electrical power to the first coupling element. The apparatus also includes electrical conditioning circuitry connecting the input electrical interface with the second coupling element. The electrical conditioning circuitry converts the input electrical power at the input electrical interface to conditioned electrical power at the second coupling element.

In accordance with another embodiment of the present invention, a light emitting apparatus is disclosed. A heat sink has a first side, a second side, and a conduit connecting the first side and the second side. The second side is adapted to connect with any one of an associated plurality of electrical adaptors each adapted to convert a selected electrical input power to a conditioned output electrical power. The light emitting apparatus also includes a plurality of light emitting diodes disposed at the first side of the heat sink and in thermal communication therewith. The light emitting diodes receive the conditioned electrical power from the selected adaptor via the conduit.

In accordance with yet another embodiment of the present invention, a method is provided for retrofitting a lamp fixture configured to receive an MR- or PAR-type lamp in an electrical receptacle with an LED-based lamp. An LED-based lamp is selected that conforms at least to a diameter of the MR- or PAR-type lamp. A connector module is selected that conforms with the electrical receptacle of the lamp fixture. The selected LED-based lamp and the selected connector module are mechanically joined to form an LED-based retro-fit unit, the mechanical joining effectuating electrical connection therebetween.

In accordance with still yet another embodiment of the present invention, a lamp is disclosed, including an optics module and an electronics module. The optics module includes a plurality of LEDs arranged on a printed circuit board, and a heat sink having a conduit for conveying electrical power through the heat sink. The plurality of LEDs thermally communicate with the heat sink. The electronics module is adapted to convey power to the plurality of LEDs via the electrical conduit of the heat sink. The electronics module has a first end adapted to rigidly connect with the heat sink, and a selected electrical connector arranged on a second end for receiving electrical power. The electronics module further houses circuitry arranged therewithin for adapting the received electrical power to drive the LEDs.

One advantage of the present invention resides in its modular design which allows a single LED-based optics module to connect with a plurality of different power sources. This permits the manufacturer to produce and stock only a single type of optics module that is compatible with a plurality of different power sources.

Another advantage of the present invention resides in its modular design which permits the end user to employ a lamp in different lighting fixtures which use different power receptacles and/or which provide different types of electrical power, by selectively attaching an appropriate electronics module.

Another advantage of the present invention resides in its modular design which permits the manufacturer or end user to select from among a plurality of control protocols such as DMX, CAN, or PDA, for controlling a lamp, by selectively attaching an appropriate power interface which incorporates the selected control protocol.

Yet another advantage of the present invention resides in arranging a heat sink that connects to an LED lighting module on one end thereof, and to an electronics module on an opposite end thereof, to form a unitary lamp with heat sinking of both the LED lighting module and the electronics module.

Numerous advantages and benefits of the present invention will become apparent to those of ordinary skill in the art upon reading and understanding the following detailed description.

BRIEF DESCRIPTION OF DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION

Figure 1:
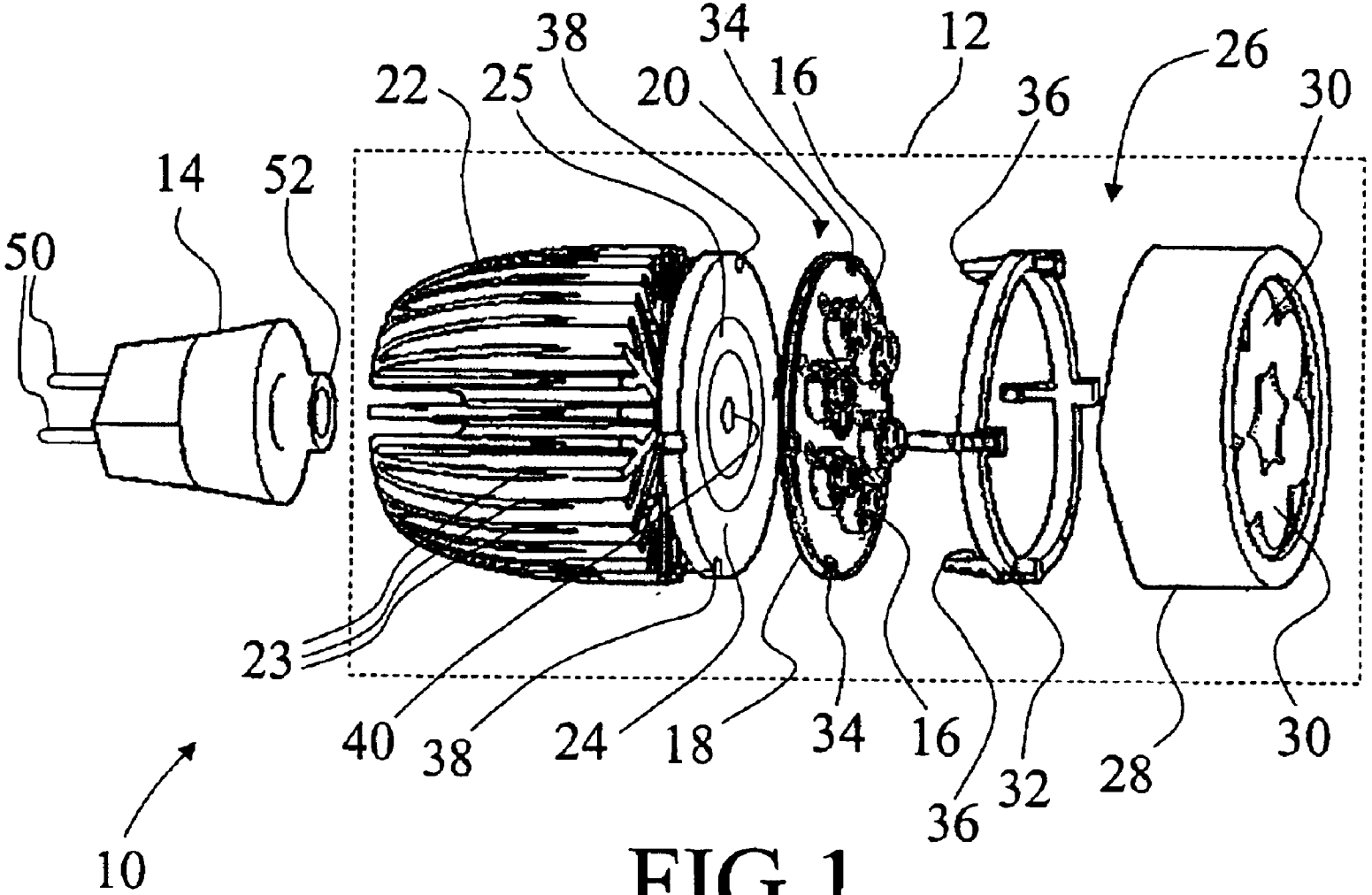
FIG. 1 shows an exploded view of a modular lamp formed in accordance with an embodiment of the invention.

With reference to FIG. 1, an exemplary modular lamp 10 includes an optics module 12 and a mating electronics module 14. The optics module 12 includes a plurality of light emitting diodes (LEDs) 16, in the illustrated embodiment six LEDs 16, arranged on a printed circuit (pc) board 18. It is also contemplated to include only a single high-brightness LED in place of the plurality of LEDs 16 in applications where a single LED can provide sufficient optical intensity. The pc board 18 provides good electrical isolation together with good thermal conductivity, and includes conductive traces (not shown) arranged thereon for interconnecting the LEDs 16 on the board. The LEDs 16 arranged on the pc board 18 will be collectively referred to herein as an LED module 20.

In one suitable embodiment, the LEDs 16 are white LEDs each comprising a gallium nitride (GaN)-based light emitting semiconductor device coupled to a coating containing one or more phosphors. The GaN-based semiconductor device emits light in the blue and/or ultraviolet range, and excites the phosphor coating to produce longer wavelength light. The combined light output approximates a white output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light. In yet another suitable embodiment, colored LEDs are used, such are phosphide-based semiconductor devices emitting red or green light, in which case the lamp 10 produces light of the corresponding color. In still yet another suitable embodiment, the LED module 20 includes red, green, and blue LEDs distributed on the pc board 18 in a selected pattern to produce light of a selected color using a red-green-blue (RGB) color composition arrangement. In this latter exemplary embodiment, the LED module 20 can be configured to emit a selectable color by selective operation of the red, green, and blue LEDs at selected optical intensities.

The LED module 20 is advantageously arranged on a heat sink 22 that provides for removal of heat generated by the operating LEDs 16 from the LED module 20. The exemplary heat sink 22 includes a plurality of heat-radiating fins 23 for removing heat. Of course, other types of heat radiating structures may be substituted therefor. In a suitable arrangement, the LED module 20 is bonded to a receiving surface 24 of the heat sink 22 by a thermal tape 25, which advantageously provides a highly thermally conductive interface between the LED module 20 and the heat sink 22. In one suitable embodiment, Thermattach™ T404 thermal tape available from Chomerics (a Division of Parker Hannifin Corporation) is used, and the heat sinking is sufficient to maintain the optics module 12 at a 70° C. contact temperature in a 25° C. ambient.

Optionally, the optics module 12 includes additional optical components for shaping the light distribution, performing spectral filtering, polarizing the light, or the like. In the illustrated lamp 10, a slidable zoom lens system 26 receives light produced by the LED module 20 and provides adjustable spot beam focusing. The zoom lens system 26 includes a lens assembly 28 having six individual lenses 30 corresponding to the six LEDs 16 and an aligning frame 32 that secures to the lens assembly 28 and aligns the lens assembly 28 with the LED module 20 through notches 34 in the LED module 20. The lens system 26 is slidably adjustable to vary the distance between the lenses 30 and the LEDs 16 to effectuate variable spot beam zooming. The sliding mechanism is limited by clips 36 that fasten in notches 38 of the heat sink 22. The clips 36 further serve to secure the zoom lens system 26 to the heat sink 22.

The exemplary optics module 12 includes the light-producing elements 16, cooperating optical elements 26, and the thermal heat sink 22. However, the optics module 12 includes only very limited electrical components, limited to the pc board 18 and electrical leads (not shown) arranged in an electrical conduit 40 passing through the heat sink 22. In one suitable embodiment, the LEDs 16 are all of the same type and are interconnected in series, parallel, or a series-parallel electrical combination on the pc board 18 which in turn connects to positive and negative input leads. In another suitable embodiment, the LEDs 16 include red, green, and blue LEDs, each connected to form a separate circuit, and there are six input leads (positive and negative leads for the red LEDs; positive and negative leads for the green LEDs; and positive and negative leads for the blue LEDs). Of course, those skilled in the art can select other electrical arrangements.

The electrical power requirements of the optics module 12 are essentially determined by the electrical characteristics of the LEDs 16 and the electrical circuits formed by the conductive traces of the pc board 18. A typical LED optimally operates at a few hundred milliamperes or less, and at a few volts, for example at 4 volts. Hence, the optics module 12 is preferably driven at a few volts to a few tens of volts and at a few hundred milliamperes to a few amperes, depending upon the electrical interconnections, such as series, parallel, or series-parallel, arranged on the pc board 18.

The electronics module 14 mechanically and electrically couples with the optics module 12 at an opposite end of the heat sink 22 from the LED module 20. The electronics module 14 includes a suitable electrical input connector, in the embodiment of FIG. 1 a GU-type two-prong connector 50 known to the art, and an output coupler 52 that is adapted to mechanically connect with the heat sink 22 and electrically connect with the leads (not shown) of the LED module 20. The electrical connector 50 is adapted to connect with a selected power supply, such as a standard 240 V a.c., 50 Hz electrical supply commonly used in Europe.

Figure 2C:
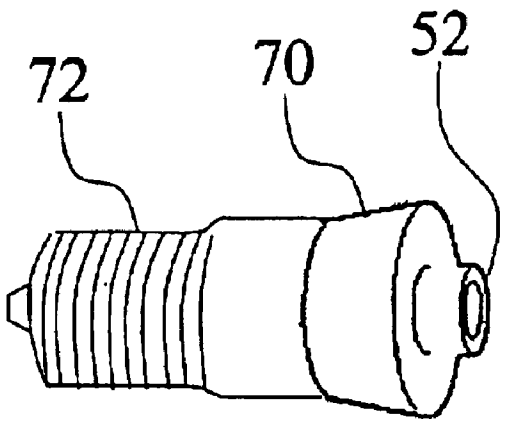
FIG. 2C shows yet another electronics module which is compatible with the optics module of the lamp of FIG. 1, wherein the electronics module of FIG. 2C includes an Edison-type threaded connector.
Figure 2B:
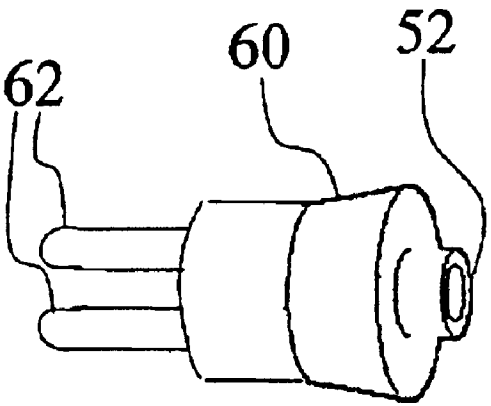
FIG. 2B shows another electronics module which is compatible with the optics module of the lamp of FIG. 1, wherein the electronics module of FIG. 2B includes a different GU-type two-prong connector.
Figure 2A:
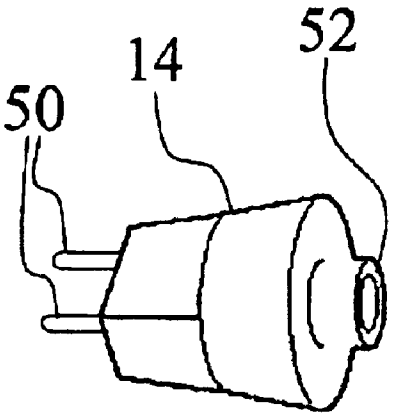
FIG. 2A shows the electronics module of the lamp of FIG. 1, which module includes a GU-type two-prong connector.

With continuing reference to FIG. 1 and with further reference to FIG. 2, the lamp 10 is modular. The optics module 12 can be powered by various types of electrical inputs including different types of electrical connectors by selecting an appropriate electronics module. For example, the GU-type connector 14 of FIGS. 1 and 2A is optionally replaced by another type of GU connector 60 shown in FIG. 2B that has different, for example thicker prongs 62. In suitable embodiments, a first electronics module includes a GU-10 electrical connector for connecting to 240V a.c., 50 Hz power, while a second electronics module includes a GU-5.3 electrical connector for connecting to a 12V d.c. power supply. As shown in FIG. 2C a connector 70 having an Edison-type threaded connector 72 is optionally used.

The electronics modules 14, 60, 70 are exemplary only. Those skilled in the art can select other connectors appropriate for powering the optics module 12 using other electrical inputs.

It will further be appreciated that although various types of electrical connectors 50, 62, 72 are embodied in the various electronics modules 14, 60, 70, the modules include the same output coupler 52, which in the illustrated embodiment attaches to the heat sink 22 by a snap-fit that simultaneously effectuates an electrical connection between the electronics module 14, 60, 70 and the optics module 12. In addition to the output coupler 52 of the various electronics modules 14, 60, 70 having a common mechanical connection, the output coupler 52 supplies the same conditioned electrical power to the optics module 12. In this way, the optics module 12 is made independent of the particular power supply. Since the connection between the electronics module 14, 60, 70 and the optics module 12 does not directly interface with the power supply, it can take various mechanical forms. The connection should be a rigid connection so that the lamp 10 comprises a unitary rigid body. In addition to the illustrated snap-fit, it is contemplated to effectuate the electrical and mechanical connection between the electronics module and the optics module using various other mechanisms such as a twist-lock, a spring loaded connection, screws or other auxiliary fasteners, and the like.

The above connections are advantageously selectively detachable so that the end user can select and install an appropriate electronics module for the application. Alternatively, a permanent connection such as a soldered or riveted connection is employed. Although such a permanent connection does not provide electrical input modularity to the end user, it is advantageous for the manufacturer because the manufacturer can produce and stock only a single type of optics module. When lamp orders are received, the appropriate electronics module is selected and permanently connected to the optics module. A permanent attachment also advantageously can be made more reliable and weatherproof, including for example an adhesive sealant applied at the connection, and as such can be preferable for outdoor applications.

Figure 3:
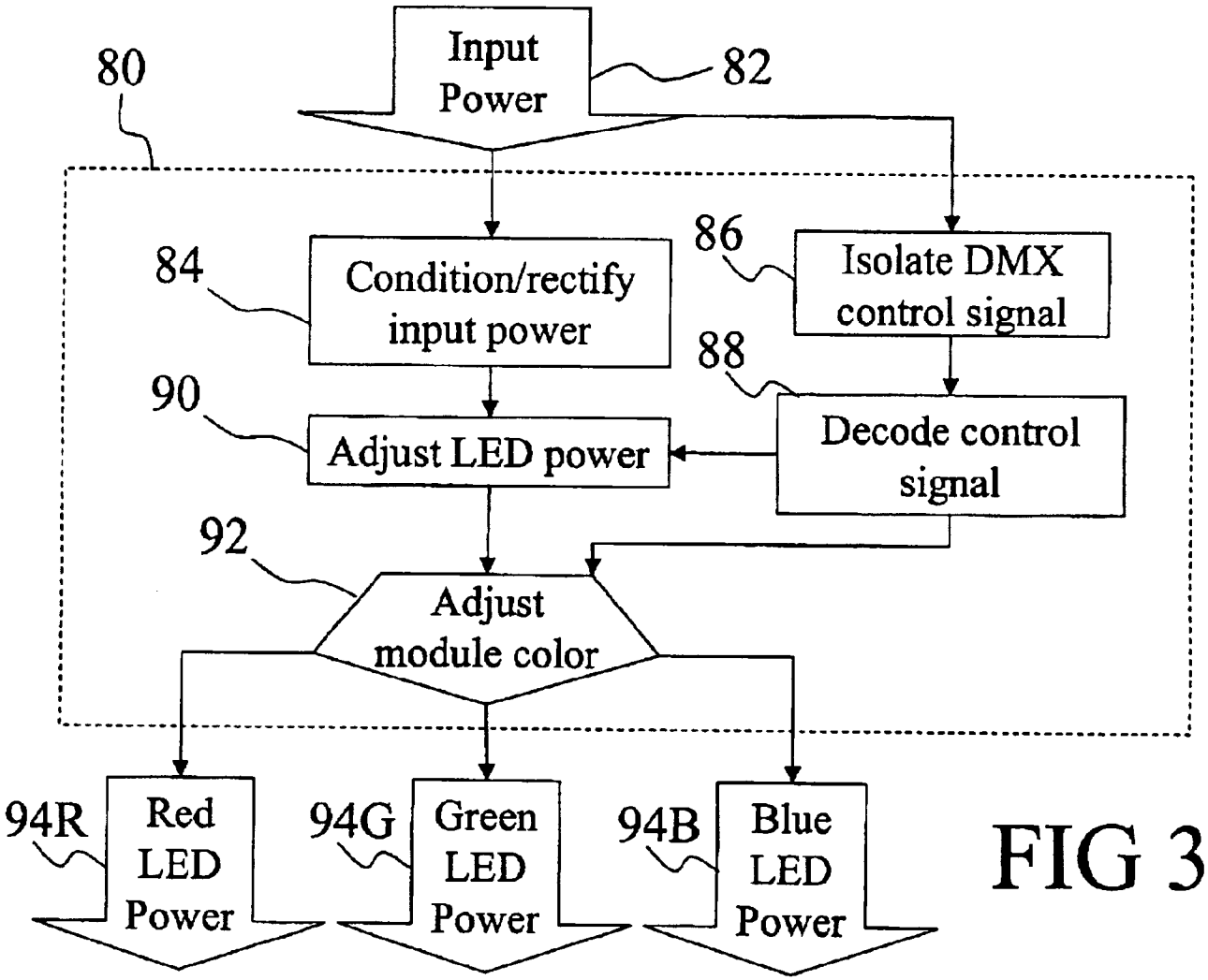
FIG. 3 shows a diagrammatic representation of the power conditioning electronics of an exemplary electronics module.

With continuing reference to FIGS. 1 and 2A–2C and with further reference to FIG. 3, each electronics module 14, 60, 70 also contains suitable electronic components 80 for converting the input electrical supply power 82 (received at one of the exemplary connectors 50, 62, 72) to conditioned output electrical power delivered to the output coupler 52 and adapted for driving the optics module 12. The received input power 82 is conditioned in a step 84. The conditioning 84 in the case of an a.c. input preferably includes rectification, since the LEDs are advantageously driven by a d.c. current. In one suitable embodiment, a switching power supply of a type known to the art is used for the power conditioning and rectification 84 of an a.c. input power 82, along with optional EMI/RFI filtering. Of course, the detailed electronics for performing the conditioning 84 depends upon the type of the input power supply and the power output desired for the optics module 12. Those skilled in the art can readily select appropriate electronics and component values therefor to perform the power conditioning step 84.

In one embodiment (not shown), the output of the conditioning step 84 is applied directly to the output coupler 52 to drive the optics module 12. However, in the illustrated embodiment of FIG. 3, the lamp 10 is selectably controlled using a network protocol, namely in FIG. 3 a DMX-512 protocol. As is known to those skilled in the lighting arts, the DMX-512 protocol in a suitable embodiment includes a low amplitude, high frequency control signal which is superimposed on the received power 82. Hence, in a step 86 the DMX control signal is isolated from the input power supply through a high impedance filtering circuit, and decoded in a step 88 by a microprocessor, DMX-512 microcontroller, or application-specific integrated circuit (ASIC).

The DMX-512 protocol provides for controlling at least the light intensity and the light color. In incandescent lamps, control of light color is typically achieved by cooperatively controlling a plurality of such lamps, for example cooperatively controlling red, green, and blue stage spotlights, to obtain a selected illumination color. Because an LED module can include a plurality of LEDs of different colors, e.g. red, green, and blue LEDs, in the same module, an individual LED module can be color controlled via the DMX-512 controller, by independently controlling electrical power to the red, green, and blue LEDs.

With continuing reference to FIG. 3, the decoded DMX signal provided by the decoding step 88 is used to adjust the LED power in a step 90, and optionally is also used to adjust the lamp color in a step 92, the latter being applicable to embodiments where the LED module 20 includes multiple LEDs of different colors. The LED power adjusting 90 can, for example, effectuate a dimmer switch operation. The output of the step 92 are, in a RGB embodiment, three output power-conditioned signals 94R, 94G, 94B corresponding to the red, green, and blue LED power leads, respectively. Of course, for a single color lamp the color adjustment step 92 is omitted and only a single conditioned output power, optionally power adjusted 90, is supplied to the output coupler 52 to drive the optics module 12.

Although lamp control using a DMX-512 network protocol is illustrated in FIG. 3, those skilled in the art will appreciate that other control protocols can be implemented in combination with or instead of the DMX-512 control. For example, CAN or PDA network capability can be incorporated into the electronics module 14, 60, 70. Furthermore, since the controlling is contained within the electronic module and is independent of and transparent to the optics module 12, each electronics module can have a different controller or can have no control at all. Hence, converting the lamp 10 from a DMX-512 control to a CAN network protocol involves merely replacement of the electronics module.

In a suitable embodiment, the electronic components 80 are arranged inside the electronics module 14, 60, 70 on one or more printed circuit boards (not shown) and/or are arranged as one or more integrated circuits. The electronics module 14, 60, 70 is preferably potted with a thermal potting compound to provide shock and vibration resistance, to improve thermal heat sinking of the electronics, and to exclude moisture and other contaminants.

If the connection between the electronics module 14, 60, 70 and the heat sink 22 is thermally conductive, then the heat sink 22 can, in addition to heat sinking the LED module 20, also provide heat sinking for the electronics module 14, 60, 70. In a permanent, non-detachable connection of the electronics module 14, 60, 70 with the heat sink 22, thermal conduction can be improved by, for example, soldering the components together with thermally conductive solder. For a detachable arrangement, a thermally conductive disk or other element (not shown) can be inserted in between to improve the thermal conductance.

Those skilled in the art will recognize that the described modular lamp 10 overcomes significant problems which LED lamp manufacturers have previously struggled with. For example, the lamp 10, with or without the zoom feature of the optics 26, is suitable for replacing a conventional MR- or PAR-type lamp in a lamp fixture that includes one of a plurality of types of electrical receptacles. The electronic connector module 14, 60, 70 matching the mechanical connection and electrical characteristics of the receptacle is selected and joined to the optics module 12, either at the factory or by the end user, to form an LED-based retro-fit lamp which is installed into the electrical receptacle of the lamp fixture in the usual manner, for example by screwing in the LED-based lamp when using an Edison-type threaded connector. The optics module 12 is selected to provide the desired optical output, for example the desired illumination intensity and spot size. The optics module 12 is further preferably selected to substantially conform with at least a diameter of the MR- or PAR-type lamp. Thus, for example, a PAR-20 lamp is preferably replaced by an optics module 12 having a diameter of 2.5 inches or somewhat less. Of course, if it is desired that the retro-fit lamp be compatible with a selected control protocol such as DMX, CAN, or PDA, a control module with the appropriate controller is selected and joined with the optics module 12 to form the lamp.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A lamp comprising:

an optical module including (i) a plurality of LEDs including LEDs for emitting light of first, second, and third different colors, and (ii) a heat sink thermally coupled to the LEDs, the heat sink having an electrical conduit for transmitting conditioned electrical power to the LEDs; and an electronics module receiving input electrical power and a lighting control signal, the electronics module including an output couple rigidly attaching to the optical module for delivering conditioned electrical power to the electrical conduit, the electronics module further including electrical conditioning circuitry for selectively electrically coupling the input electrical power to the output coupler based on the lighting control signal to selectively power to the LEDs of the first second and third colors to produce light of a color selected by the lighting control signal.

2. The lamp as set forth in claim 1, further including:

a circuit board in thermal contact with the heat sink and on which the plurality of LEDs are arranged, the circuit board including electrical traces for electrically interconnecting the LEDs.

3. The lamp as set forth in claim 1, wherein the electronics module includes one of an Edison-type base and a GU-type base receiving the input electrical power.

4. The lamp as set forth in claim 1, wherein the electrical conditioning circuitry includes one of:

a DMX network protocol controller;

a CAN network protocol controller; and a PDA network protocol controller.

5. The lamp as set forth in claim 1, wherein the optical module further includes:

an optical system arranged to cooperate with the LEDs to produce a light beam having a selected beam spread.

6. The lamp as set forth in claim 5, wherein the optical system includes a plurality of lenses corresponding to the plurality of LEDs.

7. The lamp as set forth in claim 1, wherein the output coupler of the electronics module is adapted to thermally communicate with the heat sink of the optical module.

8. A light emitting apparatus comprising:

a heat sink having a first side, a second side opposite the first side, and conduit connecting the first side and the second side;

a plurality of light emitting diodes disposed at the first side of the heat sink and in thermal communication therewith to heat sink the light emitting diodes; and an electronic module disposed at the second side of the heat sink and in thermal communication therewith to heat sink the electronic module, the electronic module converting electrical input power into a conditioned electrical power, the light emitting diodes receiving the conditioned electrical power from the electronic module via the conduit.

9. The light emitting apparatus as set forth in claim 8, further including:

a PC board in which the plurality of light emitting diodes are arranged, the pc board disposed at the first side of the heat sink and in thermal communication therewith.

10. The light emitting apparatus as set forth in claim 9, further including:

thermal tape bonding the pc board to the first side.

11. The light emitting apparatus as set forth in claim 8, wherein the second side of the heat sink is adapted to detachably connect with any one of a plurality of electronic modules.

12. The light emitting apparatus as set forth in claim 8, wherein the heat sink includes a radiating surface disposed between the first and second sides radiating heat away from the heat sink.

13. A method for retro-fitting a lamp fixture configure to receive an MR- or PAR-type lamp in an electrical receptacle with an LED-based lamp, the method comprising:

selecting an LED-based lamp conforming at least to a diameter of the MR- or PAR-type lamp;

selecting a selected electronic module including a connector configured to mate with the electrical receptacle of the lamp fixture, the selected electronic module being selected from amongst a plurality of electronics modules having different connectors and identical output couplers; and mechanically joining the selected LED-based lamp and the selected electronic module to form an LED-based retro-fit unit by mating the output coupler with the LED-based lamp, the mechanical joining effectuating electrical connection therebetween.

14. The retro-fitting method as set forth in claim 13, further including:

installing the LED-based retro-fit unit in the lamp fixture, the installing including mating the connector of the selected electronic module with the electrical receptacle of the lamp fixture.

15. The retro-fitting method as set forth in claim 13, wherein the mechanical joining is a detachable joining.

16. A modular lamp system comprising:

an optics module having:

a plurality of LEDs arranged on a printed circuit board, and a heat sink having an electrical conduit for conveying electrical power through the heat sink, the plurality of LEDs thermally communicating with the heat sink; and a plurality of electronics modules, each module including: (i) an output coupler adapted to mate with the heat sink to convey power to the plurality of LEDs via the electrical conduit of the heat sink, and (ii) an electrical power connector for receiving electrical power, the electronics modules each having the same output coupler but different electrical power connectors, each electronics module housing circuitry converting the electrical power received at its electrical power connector into a common output power delivered to the output coupler to drive the LEDs.

17. The modular lamp system as set forth in claim 16, wherein the optics module further includes:

a lens system comprising at least one lens arranged to receive light generated by the LEDs for modifying a characteristic of the light.

18. The modular lamp system as set forth in claim 17, wherein the lens system further includes:

an adjustment for selectively adjusting a separation between the at least one lens and the plurality of LEDs.

19. The modular lamp system as set forth in claim 16, wherein the optics module further includes:

a thermal tape disposed between the printed circuit board and the heat sink for providing thermal contact therebetween.

20. The modular lamp system as set forth in claim 16, wherein the heat sink thermally communicates with an installed one of the plurality of electronics modules to heat sink the installed electronics module.

21. The modular lamp system as set forth in claim 20, further including:

a thermally conductive disk inserted between the heat sink and the installed one of the plurality of electronics modules, the thermally conductive disk enhancing thermal communication therebetween.

22. The modular lamp system as set forth in claim 16, wherein the output coupler of each of the plurality of electronics modules detachably mates with the heat sink, the output coupler being selected from a group consisting of: (i) a snap fit, (ii) a twist lock, (iii) a spring-loaded connection, (iv) a connection secured using screws.

* * * * *